US007458751B2

(12) United States Patent
Carmichael

(10) Patent No.: US 7,458,751 B2
(45) Date of Patent: Dec. 2, 2008

(54) ACTIVE CONTROL RELEASABLE BALLAST SYSTEM FOR USE WITH DIVE EQUIPMENT

(75) Inventor: Robert Manuel Carmichael, Ft. Lauderdale, FL (US)

(73) Assignee: Trebor Industries, Inc., Fort Lauderdale, FL (US)

( * ) Notice: Subject to any disclaimer, the term of this patent is extended or adjusted under 35 U.S.C. 154(b) by 0 days.

(21) Appl. No.: 09/730,116

(22) Filed: Dec. 5, 2000

(65) Prior Publication Data

US 2002/0067955 A1 Jun. 6, 2002

(51) Int. Cl.
*B63C 11/30* (2006.01)
*B63C 9/11* (2006.01)

(52) U.S. Cl. ..... 405/186; 441/88; 441/106

(58) Field of Classification Search ..... 405/186, 405/185; 441/102, 106, 111–119, 80, 88
See application file for complete search history.

(56) References Cited

U.S. PATENT DOCUMENTS 3,536,071 A 10/1970 Ferramdo
4,623,316 A 11/1986 Ratliff
4,694,772 A 9/1987 Faulconer et al.
4,732,305 A 3/1988 Courtney et al.
4,877,167 A * 10/1989 McNemar ..... 224/269
4,887,932 A 12/1989 Toth
4,907,729 A 3/1990 Hess, III
4,919,631 A 4/1990 Stafford
5,074,714 A * 12/1991 Franco ..... 405/186
5,076,575 A 12/1991 Eylander
5,085,163 A 2/1992 Van Tassci et al.
5,205,672 A * 4/1993 Stinton ..... 405/185
5,267,815 A 12/1993 Feder
5,337,935 A 8/1994 Chambonnet
5,516,233 A 5/1996 Courtney
5,516,234 A 5/1996 Duchesne
5,641,247 A * 6/1997 Seligman ..... 405/186
5,746,542 A * 5/1998 Carmichael ..... 405/186
5,860,769 A * 1/1999 Seligman ..... 405/186
5,913,640 A * 6/1999 Bortner ..... 405/186
5,944,450 A * 8/1999 Anderson ..... 405/186
5,957,079 A * 9/1999 Wessels ..... 114/315
6,030,147 A * 2/2000 Bowden ..... 405/186

(Continued)

FOREIGN PATENT DOCUMENTS

EP 1361153 A1 * 11/2003

(Continued)

OTHER PUBLICATIONS

Halcyon Internet Web page, titled "Active Control Ballast", at URL http://www.halcyon.net/mc/06a_mc.shtml. downloaded on Aug. 22, 2000 and Aug. 28, 2001.*

*Primary Examiner*—Ajay Vasudeva
(74) *Attorney, Agent, or Firm*—Daniel S. Polley, P.A.

(57) ABSTRACT

An active control releasable ballast system for dive equipment is disclosed which in one embodiment includes a removable pocket that is secured with a side release buckle within a fixed pocket. The buckle is required to be opened before the weight contained in the pocket can be dropped or given to another individual in or out of the water. Thus, the release of the weights is a conscious and deliberate act.

13 Claims, 15 Drawing Sheets

U.S. PATENT DOCUMENTS

| | | | | |
|---|---|---|---|---|
| 6,132,142 | A | 10/2000 | Carmichael | |
| 6,499,913 | B2 * | 12/2002 | Garofalo | 405/186 |
| 6,527,480 | B2 * | 3/2003 | Angelini et al. | 405/186 |
| 6,758,635 | B1 * | 7/2004 | Feng | 405/186 |
| 6,881,011 | B1 * | 4/2005 | Carmichael | 405/186 |
| 6,966,726 | B2 * | 11/2005 | Kawashima | 405/186 |
| 7,104,729 | B2 * | 9/2006 | Cressi | 405/186 |
| 2003/0211790 | A1 * | 11/2003 | Cressi | 441/88 |

FOREIGN PATENT DOCUMENTS

| | | | |
|---|---|---|---|
| FR | 8517568 | | 11/1985 |
| GB | 2287870 | A * | 10/1995 |
| JP | 2001247084 | A * | 9/2001 |

* cited by examiner

ACTIVE CONTROL RELEASABLE BALLAST SYSTEM FOR USE WITH DIVE EQUIPMENT

BACKGROUND OF THE INVENTION

1. Field of the Invention

The present invention relates generally to weight systems for dive equipment and more particularly to an active control releasable ballast system for use with dive equipment such as, but not limited to, dive belts, buoyancy compensators and diver harnesses.

2. Background of the Invention

Historically the cumbersome weight belt has provided the basic necessity of applying sufficient ballast to the body of a diver to obtain negative buoyancy for an unpropelled descent beneath the water. In more recent years a variety of buoyancy compensator ("BC") and diver harness attached releasable weight systems have gained popularity. To date, none have sufficiently answered the majority of the basic premises of a safe, reliable and practically applicable releasable weight system. Current technology does not provide ease of use to a degree in which divers will actually release and re-insert the ballast for either practical or practice purposes on each dive. Conventional weighting systems are also notorious for shifting during a dive and creating balance and fit problems.

Since the inception of dive training organizations the dive industry has been fixated on "single point right hand" weight release systems and until recently did not consider any convenient options. In the early general consensus-forming period, reliable buoyancy aids with constant, variable volume, reusable and cost effective inflation did not exist. The only device known was an inflatable life preserver, which was inflated orally or by expensive non-reusable CO2 cartridges. The "horse collar" life vest device would become fully inflated and unsuitable for a subsequent descent without substantial time commitment to restore the device to the deflated and re-armed condition.

This "given" policy was predominantly the result of the equipment options and lack of understanding the role that rate of ascent plays in many dive accidents. Releasing all of the ballast at one time is not a reasonable and prudent action. A minimum amount of ballast release is required to establish sufficient positive buoyancy (considerably less than the full amount) to make a safe and un-propelled ascent from a distressing situation at depth. With the advent of the "power inflator", BCs assumed the dual roles of a buoyancy adjuster at depth and a life vest at the surface. Also at this point in time, the single point, right hand release weight belt identified above became less critical as the sole means of mechanically assisting a diver achieving neutral and/or positive buoyancy.

The first successful widespread BC integrated weight systems failed at addressing the issue of controlling the ballast after activation of the release mechanism. Most current designs focus solely on the ability to quickly release the divers ballast but not control all or part of it immediately following primary release. Non-emergency values such as the ability to pass the weight off to a buddy or land it in a vessel once reaching the surface where generally not addressed until recently. Any subsequent designs that have addressed post primary release control have relied on the hook and loop fastener to provide attachment and detachment of the ballast or some sort of complex mechanical fastener that cannot be randomly utilized in-water. The hook and loop designs are all subject to the inherent variability associated with these product in water borne environments. Furthermore the hook and loop fastener tends to wear and change in degree of reliability without indication. Other disadvantages of the hook and loop fasteners include: (1) it can become fowled in a single outing without positive warning, and (2) it is far too variable to adequately accommodate the wide range of holding strengths required by the diverse set of ballast requirements inherent to diving (i.e. one diver may need two pounds per side whereas the next diver may need twenty pounds). This large volume of hook and loop needed has made weight release very challenging to deploy and expensive to produce.

In the past, dive instructors have been opposed to training with integrated weight system buoyancy compensator (BC) products due to the cumbersome or impossible nature of practicing weight release and re-insertion in-water. A portion of this reluctance is simply the high degree of effort and mechanical articulation required to re-insert the ballast member post release. Visual access for the wearer is yet another detriment, but an even more insidious and significant component is the more popular reliance on hook and loop as the primary fastening mechanism. Massive variations in actual ballast amount and shape greatly impact the design criteria of the hook and loop attachment, causing the industry to go to an absolute extreme amount and placement of hook and loop product to such a degree that it is now nearly impossible to reliably release the ballast, thus, once again deferring use in training and daily practice. A more reliable, predictable, and intentionally activated design was needed.

It is therefore to the effective shortcomings of the prior art that the present invention is directed.

SUMMARY OF THE INVENTION

The present invention provides an active control releasable ballast integrated weight system for use with dive equipment, such as, but not limited to, dive belts, buoyancy compensators, diver harnesses, life jackets, life vests, etc. The system preferably includes an exterior or fixed pocket, a removable ballast member pocket, a ballast member disposed within the removable pocket, a first strap attached to the exterior pocket, a second strap attached to or approximate the exterior pocket, a male insertion member attached to a first strap, and a female receiving member attached to the second strap. The male insertion member and female receiving member combine to form a side release buckle. The system can be incorporated integral or permanently attached to the dive equipment or can be removably attached to the dive equipment. The definition of "side release buckle" excludes hook and loop fasteners.

A handle member can be attached to the removable pocket 54, preferably through a strap member. A flap can be provided integral with the removable pocket. The ballast member is disposed within the removable pocket and retained therein when the flap is in a closed position.

The side release buckle provides a single point active fastening device (which is attached solely to the fixed pocket) and handle (which is attached to the removable ballast member pocket). The design specifically secures the weight member in place and allows the second strap to pass over the leading edge of the removable ballast pocket, which is internally disposed within the fixed pocket.

A first rigid plate can be incorporated within the exterior pocket and a second rigid plate can be provided within the removable pocket. The plates are preferably shaped such that they are slightly curved and/or form a relatively small angle at approximately their halfway points. The curvature of the first rigid plate helps to conform the associated dive equipment with the user's body, by making the equipment choose a position on the user's body. The curvature of the second rigid plate helps for inserting the ballast member in a more natural and easily articulated motion.

In an alternative embodiment, separate handle 66 is eliminated by attaching the strap and either the male insertion member or the female insertion member to the removable pocket. In lieu of the removable ballast pocket, a strap with a buckle section or handle, can also be attached directly to the ballast member.

The side release buckle secures the weight pocket and at the same time acts as the primary method of holding the releasable ballast component pre-insertion and post removal when weight handling is critical to the following:

(1) Unanticipated ballast loss can be fatal due to the rate of ascent produced by natural and applied buoyant devices no-longer being countered. The conventional use of hook and loop fasteners for this application was originally introduced in the spirit of keeping with the "single hand or quick release" habits taught since the inception of recreational scuba dive training agencies; and (2) Control of the ballast generally requires a handle for a secure grip as lead is generally used as ballast and can be extremely difficult to manage compared to its relatively small size. The strategic location of the side release buckle at a point that is comfortable for the user's hand to articulate and the user's eye creates a single point release and handle control of the ballast member in a diver integrated weight system for a BC, dive belt, harness, or other dive equipment.

It is an object of the present invention to provide an active control ballast system for dive equipment, which allows for easier and more secure method of adding and/or decreasing weight.

It is a further object of the present invention to provide an active control ballast system for dive equipment, which allows for ambidextrous adding or decreasing of weight by the diver or his or her dive buddy.

It is a further object of the present invention to provide an active control ballast system for dive equipment, which uses a side release buckle and allows the buckle to act as a single point active fastening device and handle.

In accordance with these and other objects, which will become apparent hereinafter, the instant invention will now be described with particular reference to the accompanying drawings.

DETAILED DESCRIPTION OF THE INVENTION

Figure 5:
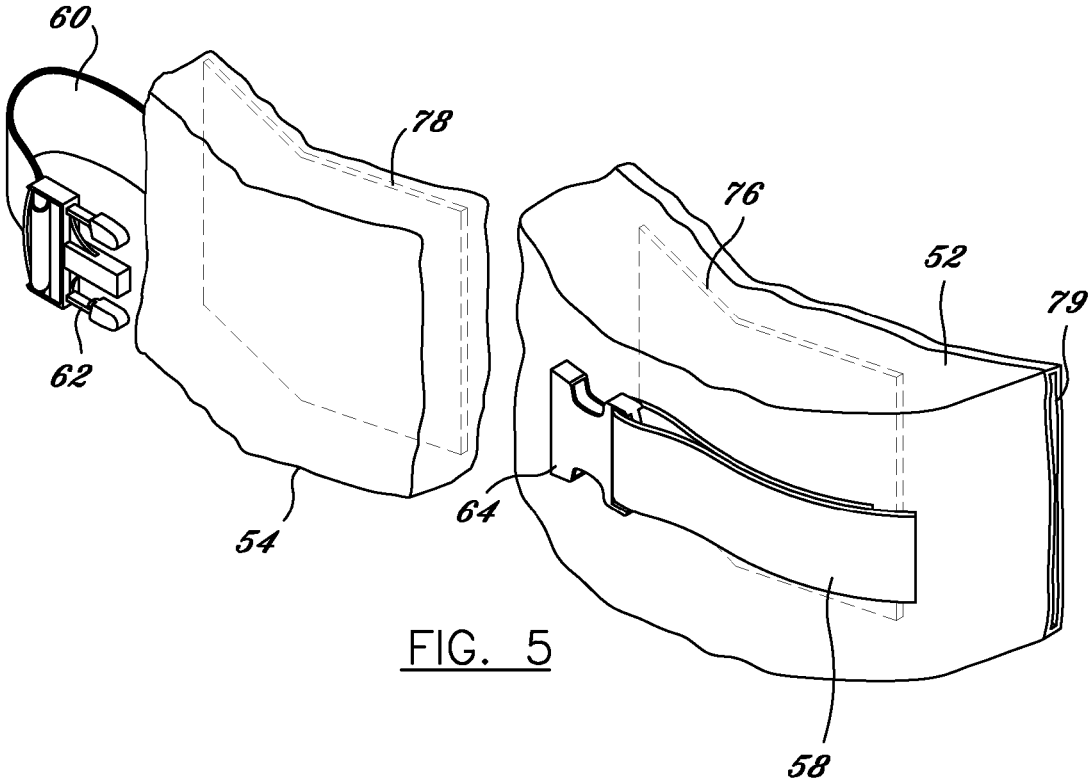
FIG. 5 is an exploded perspective view of an upgradeable add on embodiment active control releasable ballast system of the present invention.
Figure 6:
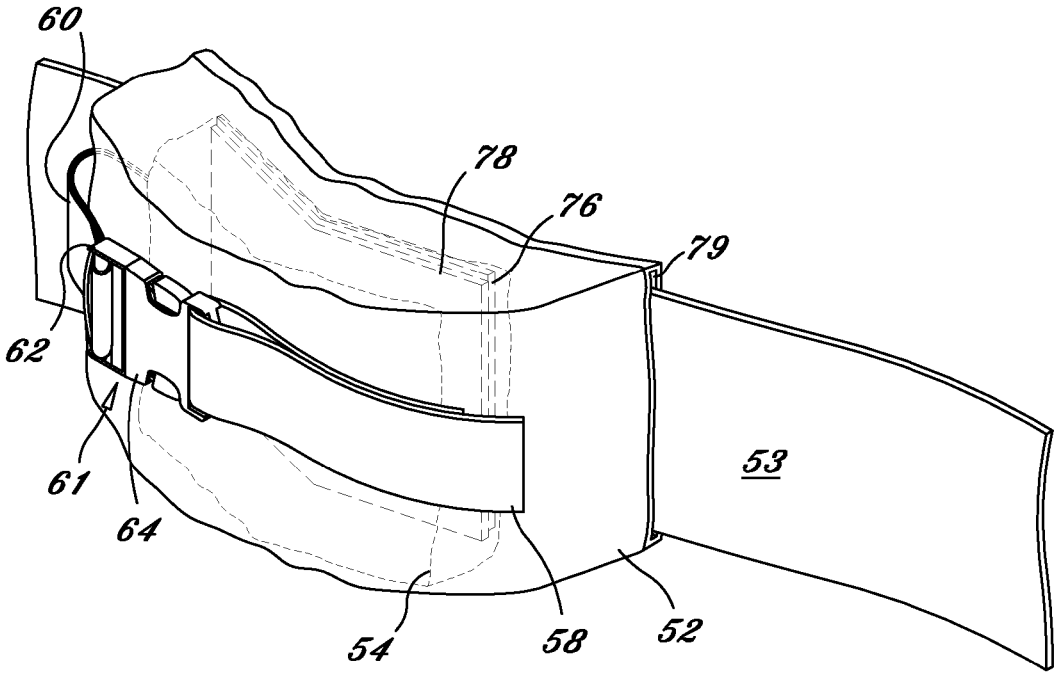
FIG. 6 is a perspective view of the embodiment of FIG. 5 shown attached to a belt portion of a piece of dive equipment, such as a dive belt or harness.
Figure 7:
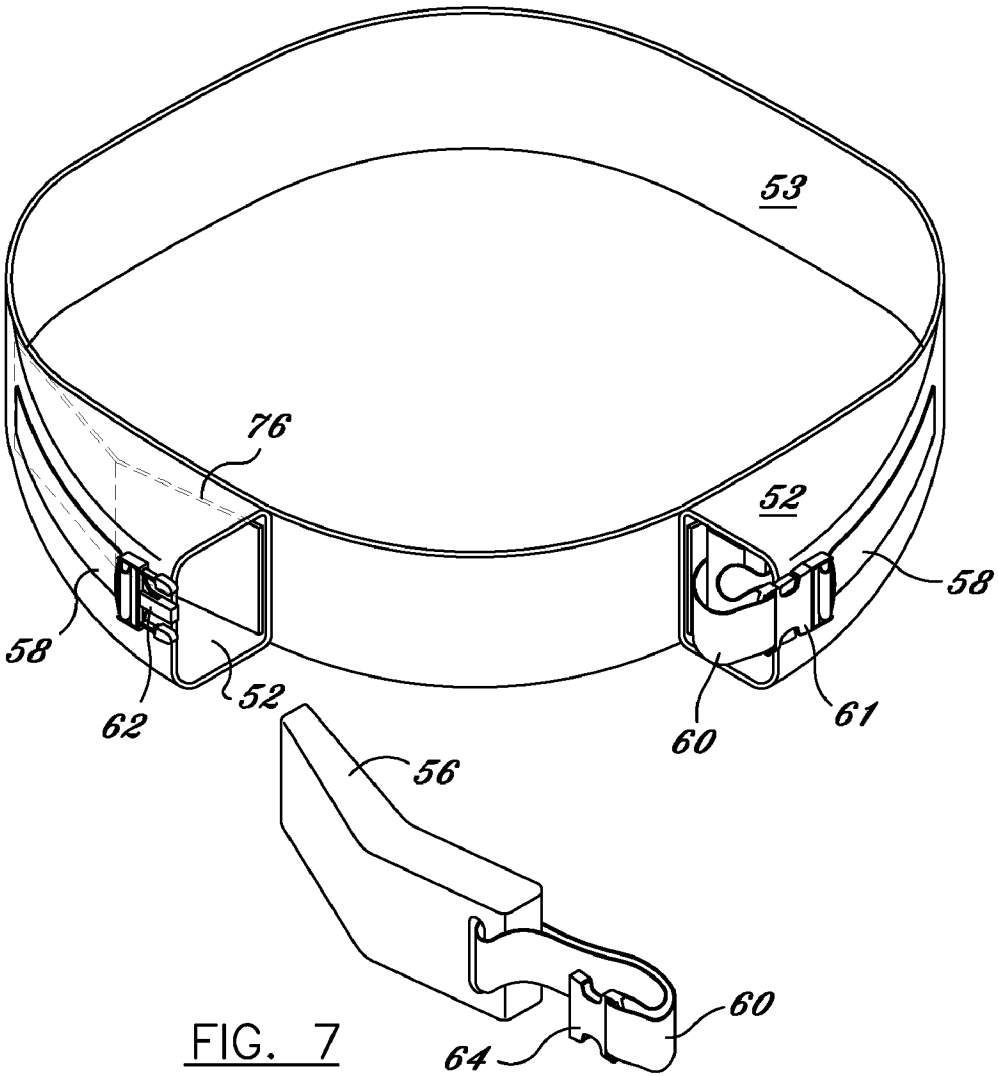
FIG. 7 is a perspective view of a further active control releasable ballast system shown used with a conventional dive belt.
Figure 8:
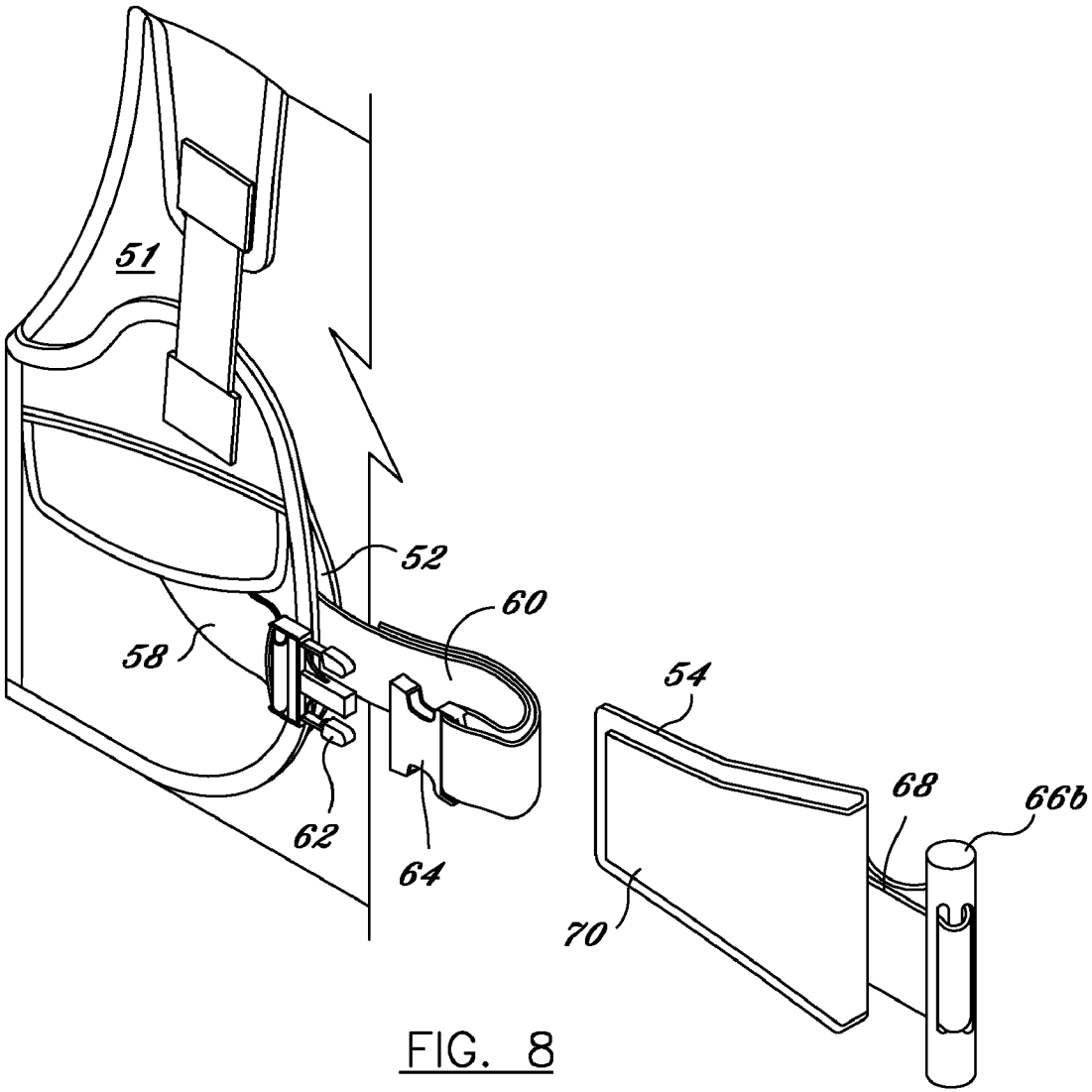
FIG. 8 is a perspective exploded view an additional active control releasable ballast system shown used with a conventional buoyancy compensator.
Figure 9:
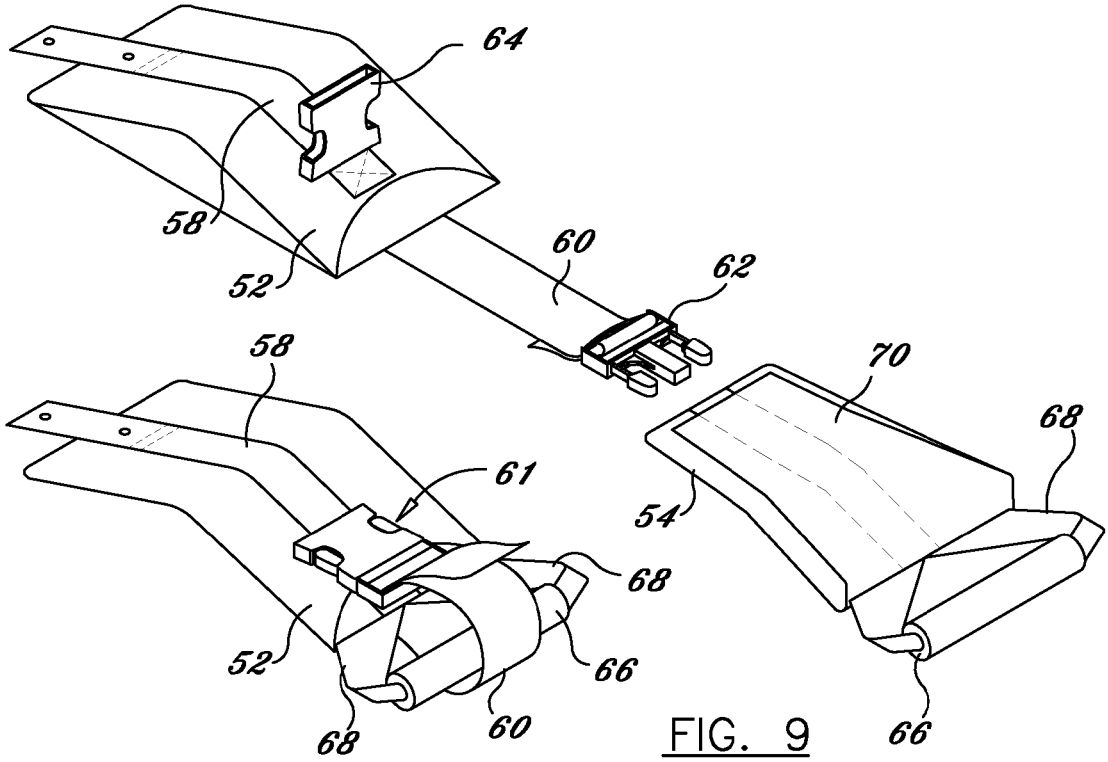
FIG. 9 are various views of the embodiment of FIG. 1.

As seen in FIGS. 1, 3, 8 and 9, a first embodiment of the active control ballast system of the present invention is illustrated and generally designated as reference numeral 50. In this embodiment, system 50 preferably includes an exterior or fixed pocket 52 (best seen in FIG. 8), ballast member pocket 54, ballast member 56 disposed within pocket 54, first strap 58 attached to exterior pocket 52, second strap 60 attached to or approximate pocket 52, a male insertion member 62 attached to either first strap 58 or second strap 60, and a female receiving member 64 attached to either second strap 60 or first strap 58 (the opposite strap to which male insertion member 62 is attached to). Preferably, male insertion member 62 and female receiving member 64 combine to form a side release buckle generally designated as buckle 61. Active control ballast system 50 can be provided or used with a dive belt 53, buoyancy compensator 51, life vest, life jacket, diver harness, etc. ("dive equipment") and all are considered within the scope of the invention. System 50, as well as all embodiments of the present invention, can be incorporated integral or permanently attached to the dive equipment or can be removably attached to the dive equipment (See FIGS. 5, 6 and 10).

A handle member 66 (66*a* in FIG. 1 or 66*b* in FIG. 8) can be attached to pocket 54, preferably through a strap member 68. A flap 70 can be provided integral with pocket 54. A means for maintaining flap 70 in a closed position with respect to pocket 54 can also be provided. In the one embodiment, the means for maintaining are hook and loop fastening members 72 and 74 provided on an inner surface of flap 70 and on an outer surface of pocket 54 (See FIG. 34). Other conventional maintaining members can be used and are also considered within the scope of the invention. Ballast member 56 is disposed within pocket 54 and retained therein when said flap 70 is in a closed position.

Side release buckle 61 provides a single point active fastening device, which is attached solely to fixed pocket 52 and handle 66 attached to removable ballast member pocket/pouch 54. The design specifically secures weight member 56 in place by strap 60 passing over the leading edge of removable ballast pocket 54, which is internally disposed within fixed pocket 52.

Figure 12:
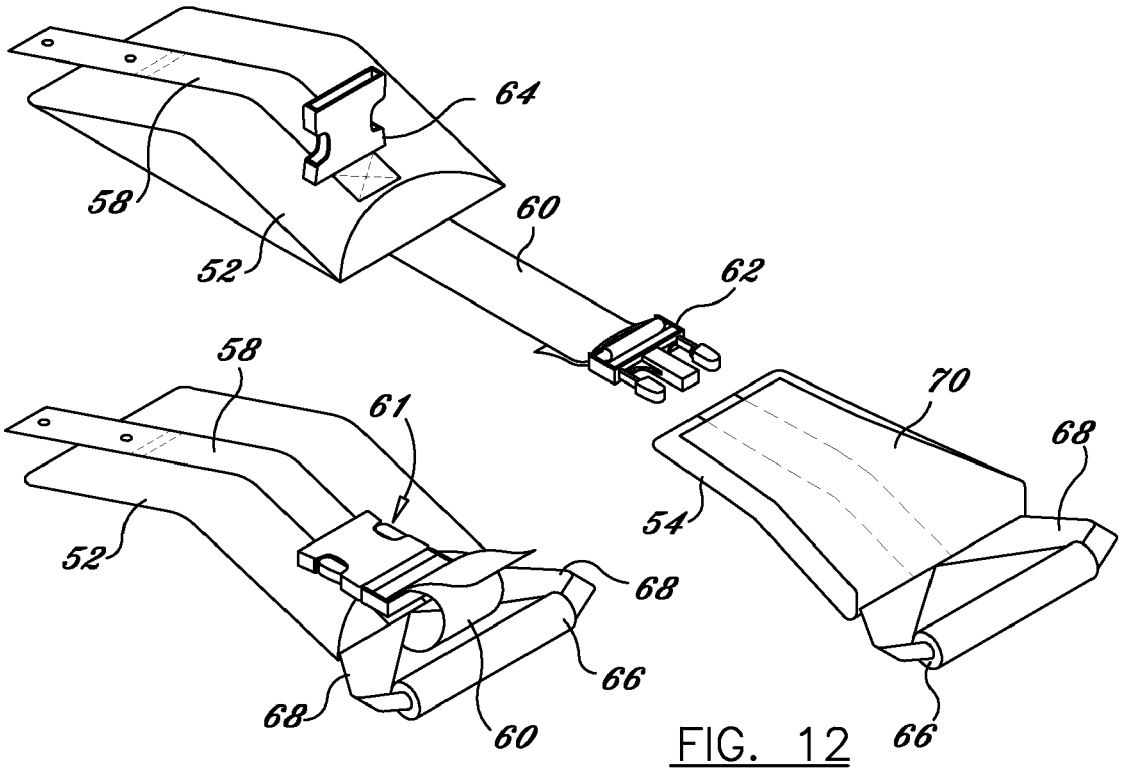
FIG. 12 are various views of the embodiment of FIG. 1 with alternative strap arrangement.

As seen in FIG. 12, with sections 62 and 64 of buckle 61 connected to each other, straps 58 and 60 of side release buckle 61 can be positioned inside the loop of handle 66. Handle 66, having a loop, can also be attached directly to ballast member 56.

Figure 14:
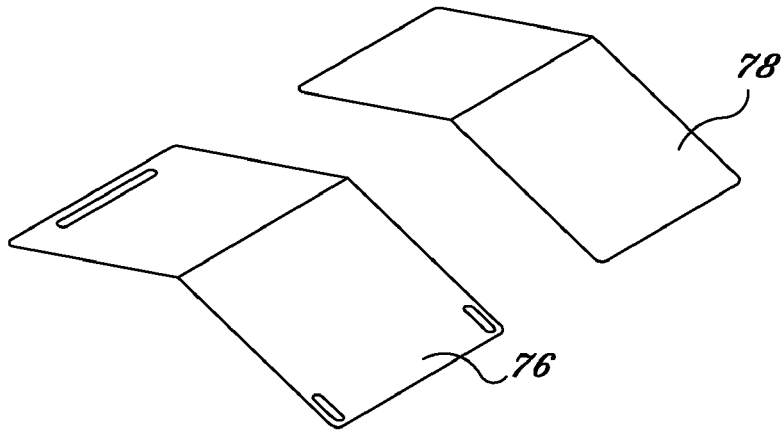
FIG. 14 is a perspective view of the plate members.

A first rigid plate 76 can be incorporated within exterior pocket 52. A second rigid plate 78 can be provided within pocket 54. Plates 76 and 78 are preferably shaped such that they are slightly curved and/or form a relatively small angle at approximately their halfway points (See FIG. 14). The curvature of rigid plate 76 helps to conform the associated dive equipment with the user's body, by making the equipment choose a position on the user's body. The curvature of second rigid plate 78 helps for inserting ballast member 56. In one embodiment, ballast member 56 can be constructed from lead. However, numerous other members, which provide ballast (i.e. other metals, sand, pieces of concrete, etc.) can also be used and all are considered within the scope of the invention. In one embodiment, plates 76 and 78 can be constructed from a relatively rigid plastic such as ABS. However, numerous other rigid materials can be used for constructing plates 76 and 78 and all are considered within the scope of the invention. Plates 76 and 78, preferably hip contoured, provided in outer pocket 52 and weight pouch 54 create a crisp contact area with the diver's body, along with a correct and comfortable fit. Given the ease of removal or insertion of weight 56, especially when plates 76 and 78 are provided, the present invention diminishes the user's inhibition to practice don and doff of ballast, which can be a valuable safety feature.

Figure 15:
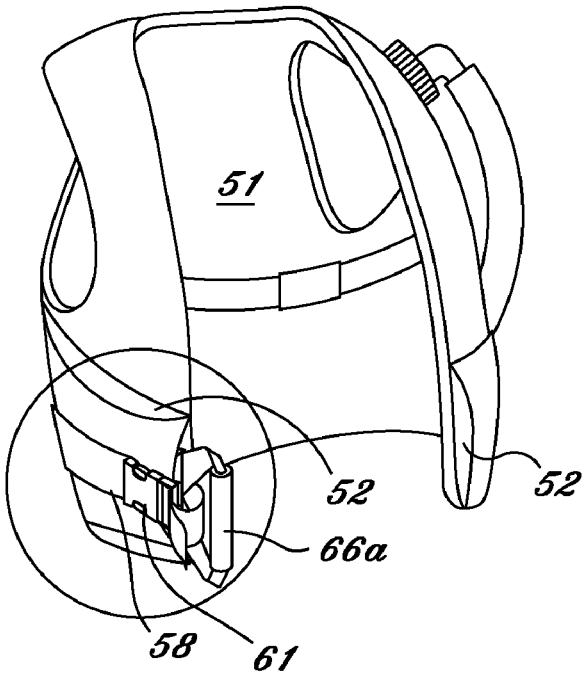
FIG. 15 is a perspective view showing the present invention used with a buoyancy compensator and illustrating two different handle styles, which can be used with the invention.
Figure 15:
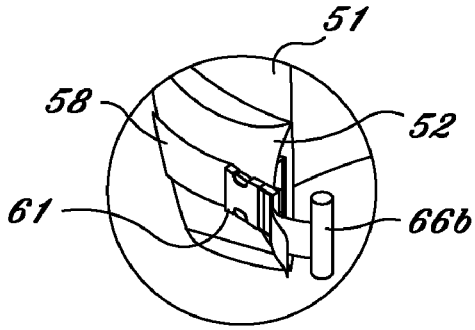
Figure 16:
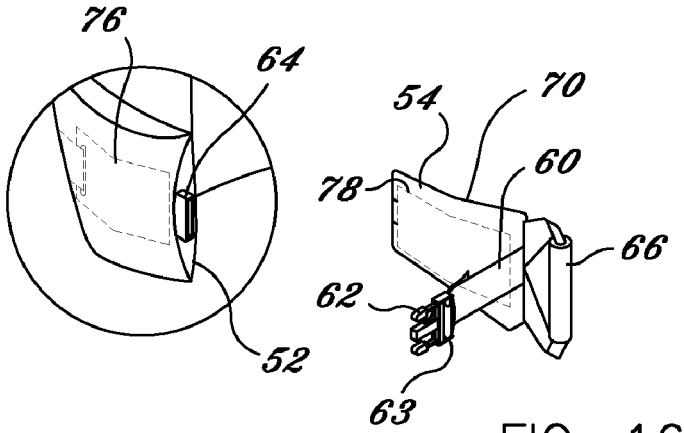
FIG. 16 illustrates an active control releasable ballast system embodiment of the present invention having a fixed pocket plate, a removable pocket plate and adjustable webbing.
Figure 23:
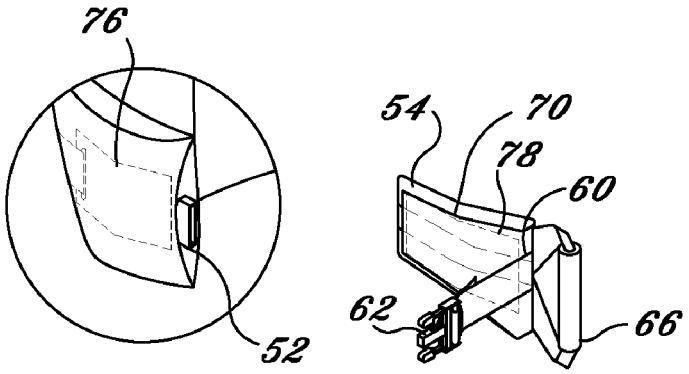
FIG. 23 illustrates the embodiment of FIG. 16 without the adjustable webbing.

As seen in FIG. 23, the position of side release buckle 61 on the dive equipment (i.e. BC 51, FIG. 15) allows it to act as a single point active fastening device and handle, with either its male or female section 62 or 64 attached to removable pocket/pouch 54 with twin mating plates 78 and 76 associated with removable pocket 54 and fixed pocket 52, respectively. This embodiment can also be provided with adjustability mechanism 63 for the webbing (strap 60) on at least lock side 62 or 64 of side release buckle 61 for total tensioning of variable ballast content 56 (See FIG. 16).

Figure 17:
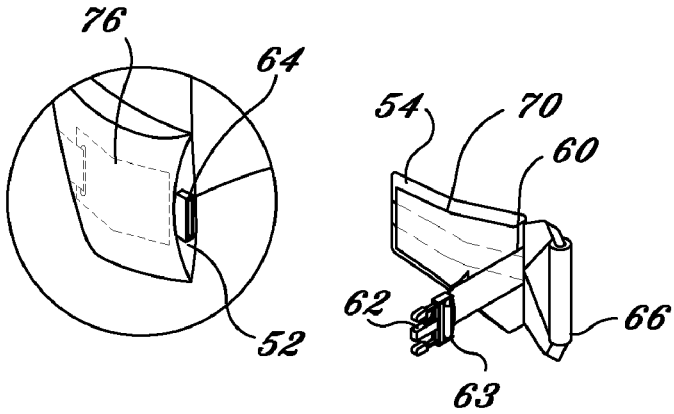
FIG. 17 illustrates an active control releasable ballast system embodiment of the present invention having a fixed pocket plat and adjustable webbing.
Figure 24:
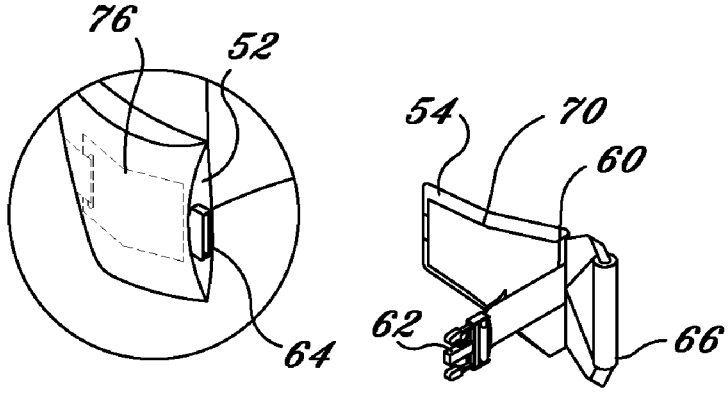
FIG. 24 illustrates the embodiment of FIG. 17 without the adjustable webbing.

As seen in FIG. 24, the position of side release buckle 61 on the dive equipment allows it to act as a single point active fastening device and handle, with either its male or female section 62 or 64 attached to removable pocket/pouch 54 with a single plate 76 provided in fixed pocket 52. This embodiment can also be provided with adjustability mechanism 63 for the webbing (strap 60) on at least lock side 62 or 64 of side release buckle 61 for total tensioning of variable ballast content 56 (See FIG. 17).

Figure 18:
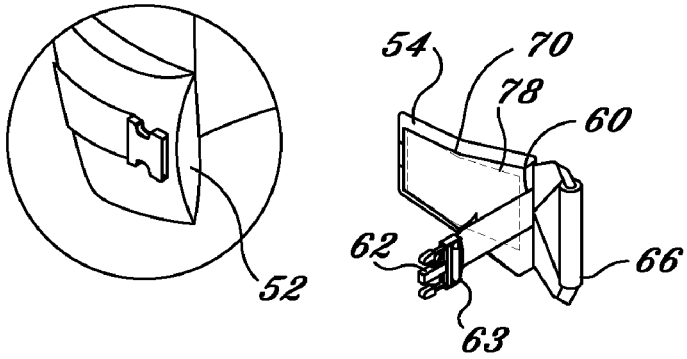
FIG. 18 illustrates an active control releasable ballast system embodiment of the present invention having a removable pocket plate and adjustable webbing.
Figure 25:
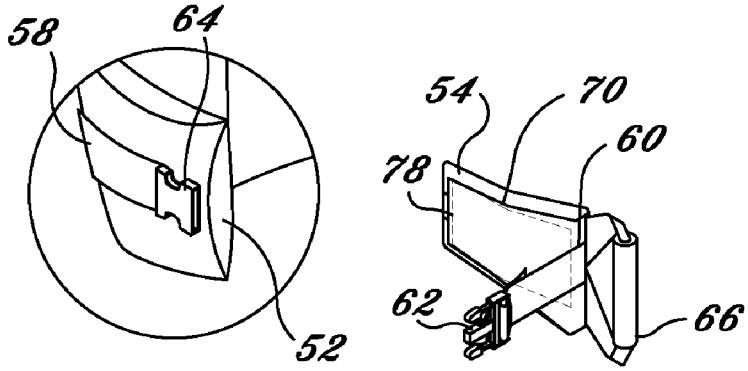
FIG. 25 illustrates the embodiment of FIG. 18 without the adjustable webbing.

As seen in FIG. 25, the position of side release buckle 61 on the dive equipment allows it to act as a single point active fastening device and handle, with either its male or female section 62 or 64 attached to removable pocket/pouch 54 with single plate 78 provided in removable pocket 54. This embodiment can also be provided with adjustability mechanism 63 for the webbing (strap 60) on at least lock side 62 or 64 of side release buckle 61 for total tensioning of variable ballast content 56 (See FIG. 18).

Figure 20:
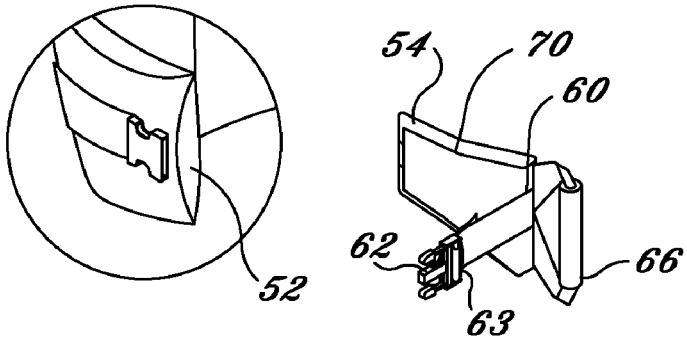
FIG. 20 illustrates an active control releasable ballast system embodiment of the present invention having adjustable webbing.
Figure 26:
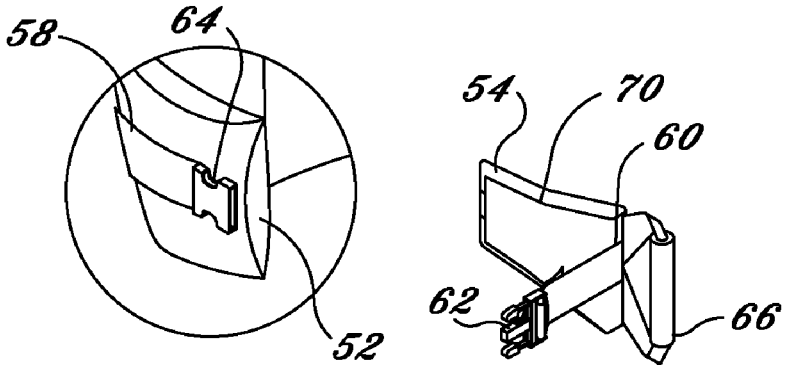
FIG. 26 illustrates the embodiment of FIG. 20 without the adjustable webbing.

As seen in FIG. 26, the position of side release buckle 61 on the dive equipment allows it to act as a single point active fastening device and handle, with either its male or female section 62 or 64 attached to removable pocket/pouch 54. In this embodiment no plates are provided. This embodiment can also be provided with adjustability mechanism 63 for the webbing (strap 60) on at least lock side 62 or 64 of side release buckle 61 for total tensioning of variable ballast content 56 (See FIG. 20).

Strap 58 or 60 can be an adjustable tensioning strap, and can be provided with hook and loop fastening members at its termination point, which preferably passes through the lock portion of side release buckle 61, to eliminate the movement of e stored weight 56 (ballast). Once strap 58 or 60 has been properly adjusted, the hook and loop fasteners mate with other hook and loop fasteners to retain strap 58 or 60 against pocket 52, the dive equipment or some other area.

Figure 2:
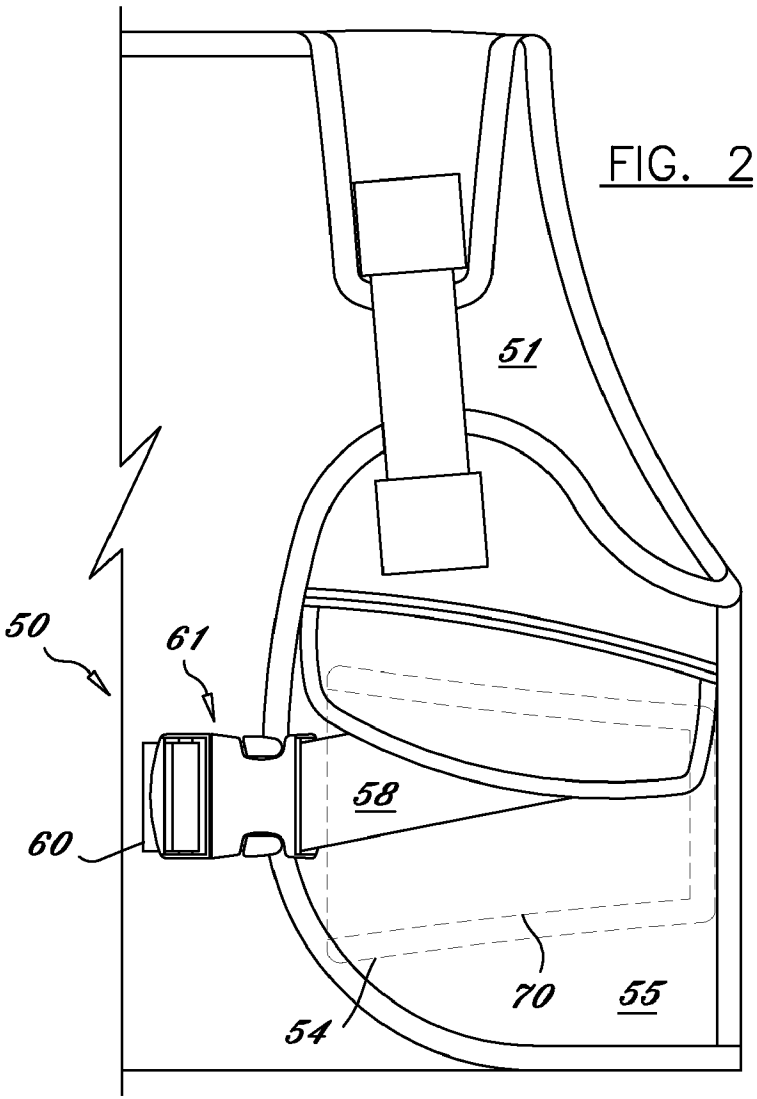
FIG. 2 is a front view of another embodiment of the active control releasable ballast system of the present invention shown used with a conventional buoyancy compensator.
Figure 1:
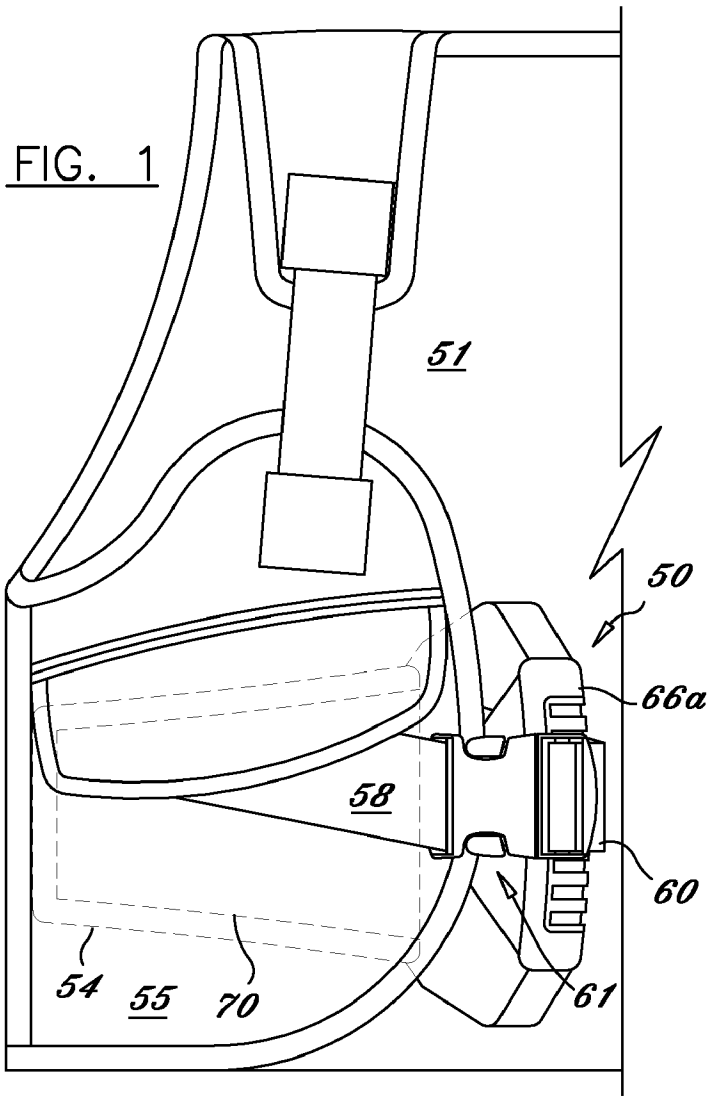
FIG. 1 is a front view of one embodiment of the active control releasable ballast system of the present invention shown used with a conventional buoyancy compensator.
Figure 4:
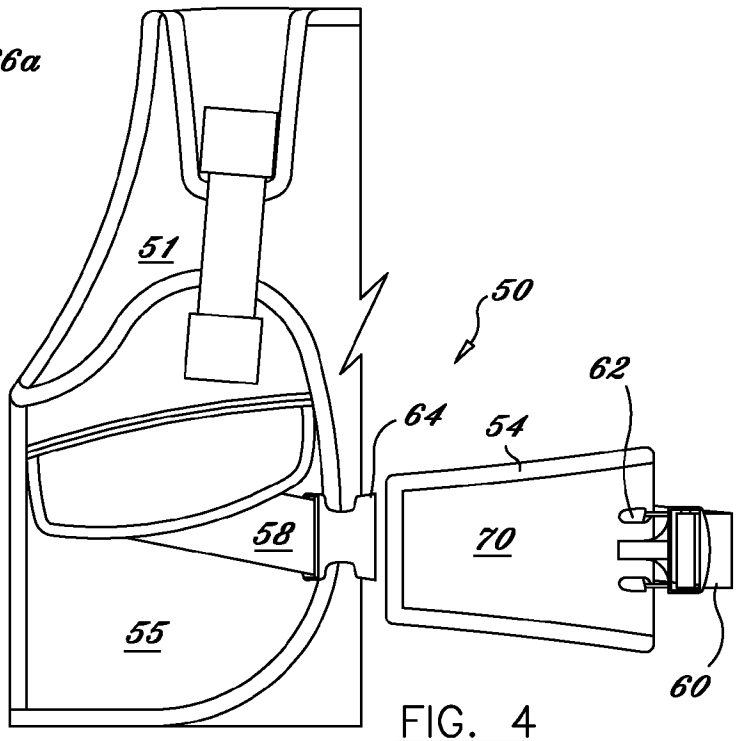
FIG. 4 is an exploded front view of the embodiment shown in FIG. 2.
Figure 3:
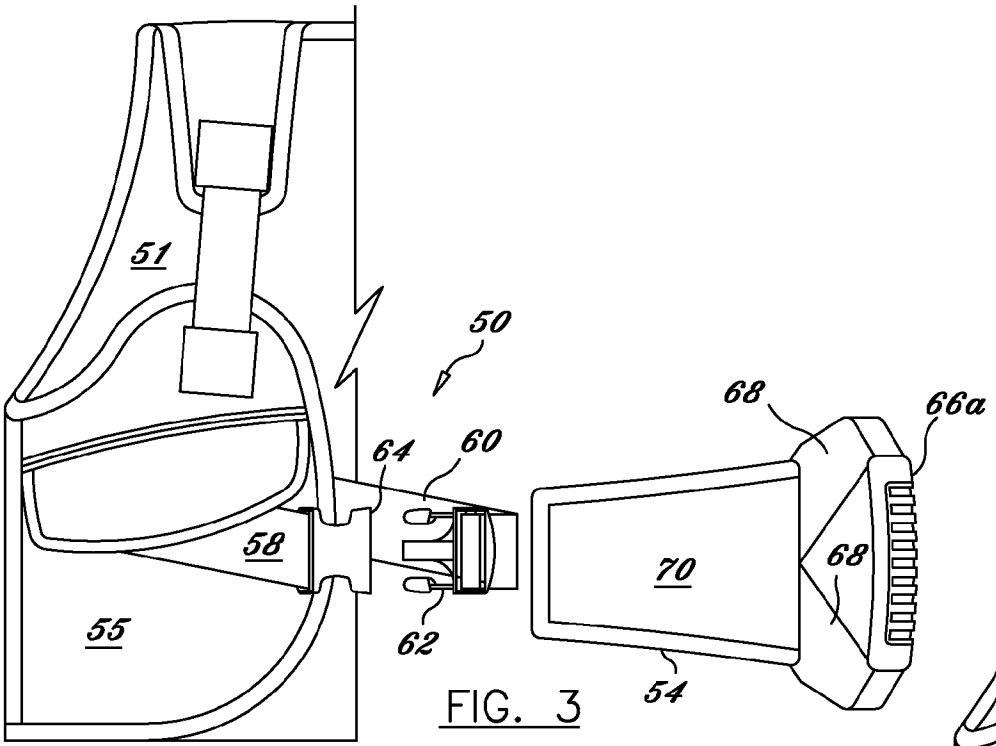
FIG. 3 is an exploded front view of the embodiment shown in FIG. 1.
Figure 13:
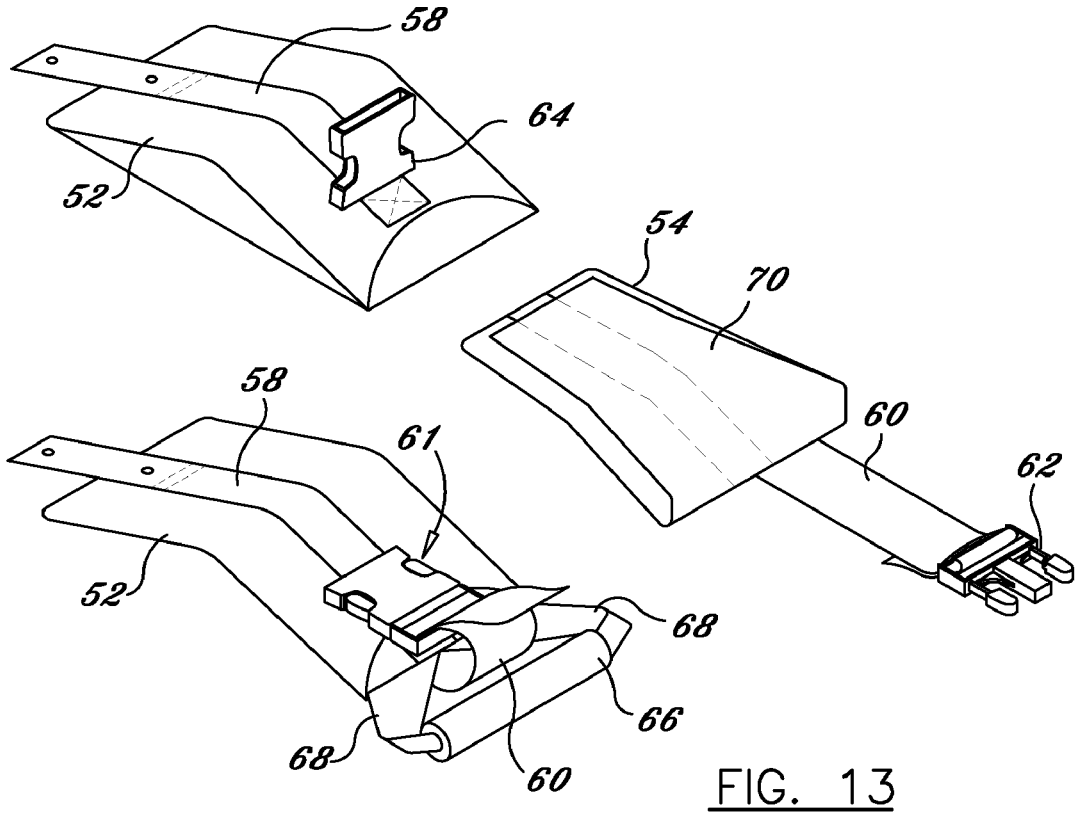
FIG. 13 are various view of the embodiment of FIG. 2 shown in removably attachable version.
Figure 21:
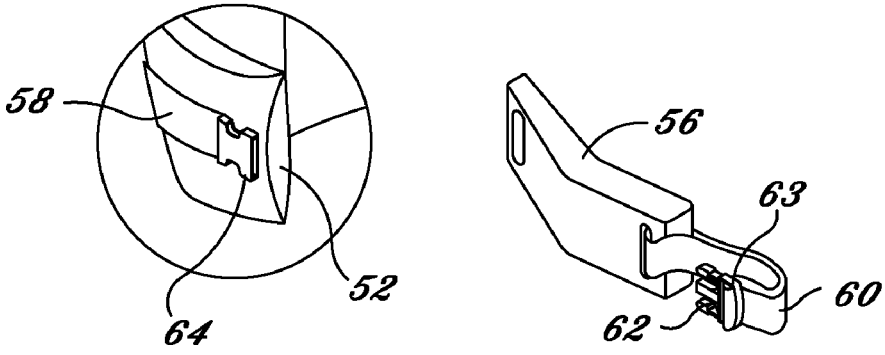
FIG. 21 illustrates an active control releasable ballast system embodiment of the present invention wherein the removable pocket is eliminated.

A first alternative embodiment for system 50 is shown in FIGS. 2, 4 and 13. This alternative embodiment eliminates separate handle 66, by attaching strap 60 and either male insertion member 62 or female insertion member to removable pocket/pouch 54. All other structure is similar to the embodiment shown in FIGS. 1, 3, 8 and 9. As seen in FIG. 13, strap 60 associated with side release buckle 61 can be attached directly to removable ballast pocket 54 and acts as singular attachment mechanism and single point active fastening device and handle for control of ballast component 56 pre-insertion, during use and post release. Additionally, in lieu of removable ballast pocket 54, strap 60 can also be attached directly to ballast member 56 (FIGS. 21 and 27).

Figure 27:
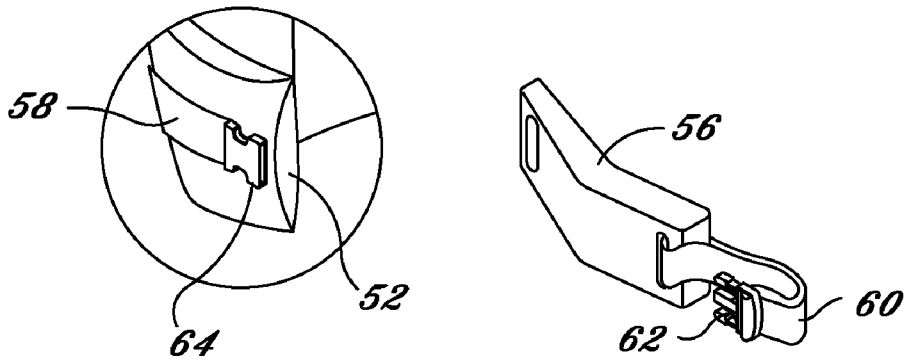
FIG. 27 illustrates the embodiment of FIG. 21 without the adjustable webbing.

As seen in FIG. 27, the position of side release buckle 61 on the dive equipment allows it to act as a single point active fastening device and handle, with either its male or female section 62 or 64 attached to ballast 56. In this embodiment no plates or removable pouch are provided. However, a conforming (curved) ballast member 56 can be provided and creates the framework to allow relatively easy insertion or removal of ballast member 56 within fixed pocket 52. Alternatively, ballast member 56 can be provided without any curvature. This embodiment can also be provided with adjustability mechanism 63 for the webbing (strap 60) on at least lock side 62 or 64 of side release buckle 61 for total tensioning of variable ballast content 56 (See FIG. 21).

Figure 22:
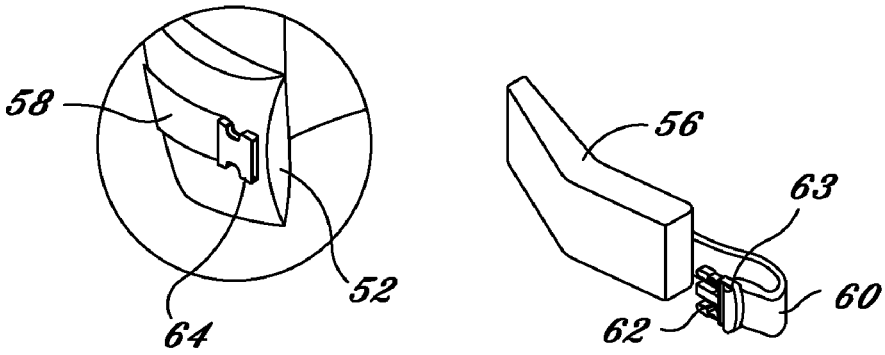
FIG. 22 illustrates an active control releasable ballast system embodiment of the present invention a removable rigid box is provided in lieu of a flexible removable pocket.
Figure 28:
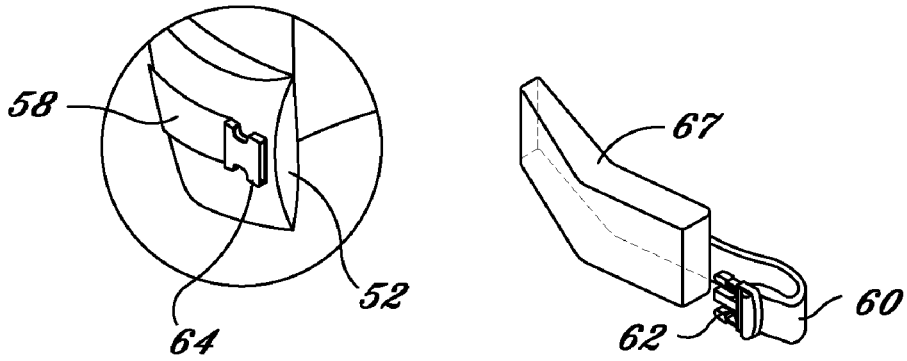
FIG. 28 illustrates the embodiment of FIG. 22 without the adjustable webbing.

As seen in FIG. 28, the position of side release buckle 61 on the dive equipment allows it to act as a single point active fastening device and handle, with either its male or female section 62 or 64 attached to a removable machine formed box 67. Box 67 acts as a variable capacity ballast containing structure allowing easier insertion or removal of ballast member 56. This embodiment can also be provided with adjustability mechanism 63 for the webbing (strap 60) on at least lock side 62 or 64 of side release buckle 61 for total tensioning of variable ballast content 56 (See FIG. 22).

Figure 31:
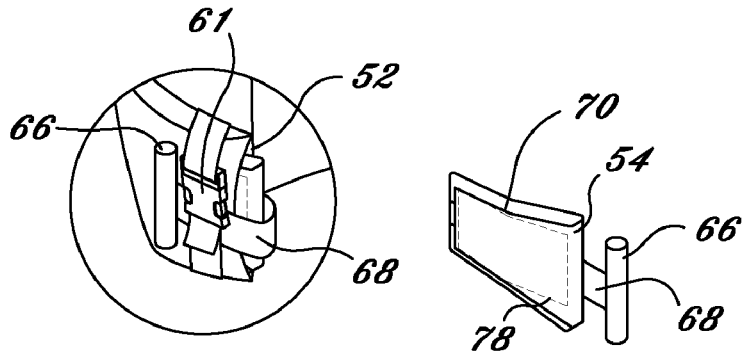
FIG. 31 illustrates a first handle position removable pocket version of the embodiment shown in FIG. 29.
Figure 32:
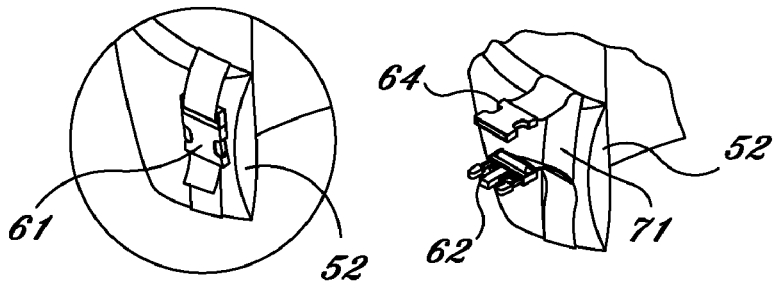
FIG. 32 illustrates a second handle position removable pocket version of the embodiment shown in FIG. 29.
Figure 33:
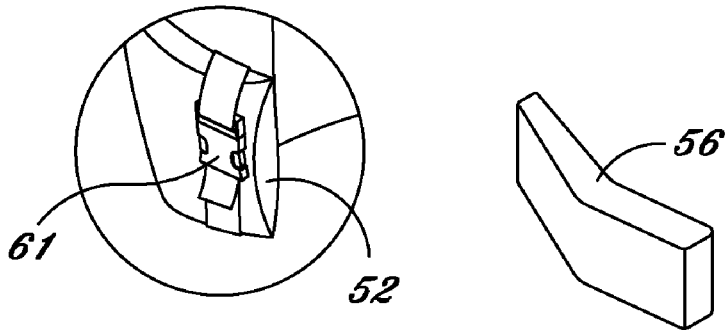
FIG. 33 illustrates a further version of the embodiment shown in FIG. 29 wherein the removable pocket is eliminated.

FIGS. 29-33 illustrate various versions of a further embodiment of the active control releasable ballast system of the present invention. Side release buckle 61, with or without strap provided over removable pocket/pouch 54 perpendicular to the length of pocket 52 and forming a closure of the outer material over a mouth of pocket 52 sufficiently tight so as to reliably secure any enclosed ballast member 56. Activation (separation-release) of side release buckle 61 sufficiently removes the tension holding the face/mouth of fixed pocket 52 closed over removable pocket 54 so that any internally disposed ballast member 56 can be actively removed by means of grabbing removable pocket 54 (FIG. 30), handle 66 attached to removable pocket 54 (FIG. 31), or even a raw ballast component 56 itself (FIG. 33).

Figure 30:
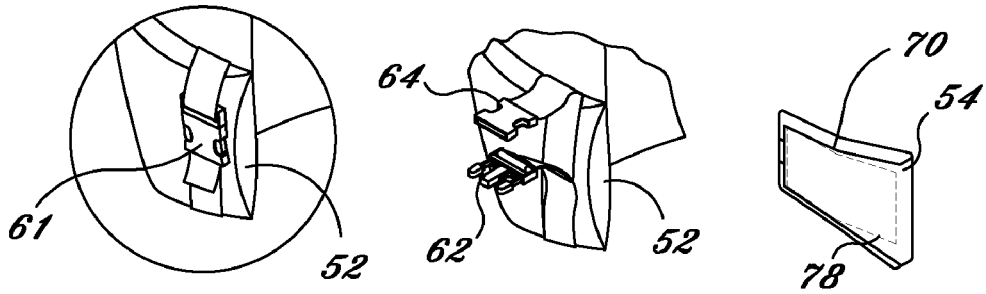
FIG. 30 illustrates a handle-less removable pocket version of the embodiment shown in FIG. 29.

As seen in FIG. 30, side release buckle 61 acts as a single point active fastening device by simply securing removable ballast pocket 54 inside fixed pocket 52 by closing a pleated expandable "mouth" section of the outer fabric of a fixed buoyancy compensator ballast system pocket 52.

As seen in FIG. 31, side release buckle 61 acts as a single point active fastening device by securing removable ballast pocket 54, with handle 66, inside fixed pocket 52 by closing the pleated expandable "mouth" section of the outer fabric of fixed buoyancy compensator ballast system pocket 52 over strap 68 of handle 66, such that handle 66 of removable pocket 54 is predisposed to being easily located immediately adjacent to side release buckle 61 for single action release and subsequent control via handle 66.

Figure 29:
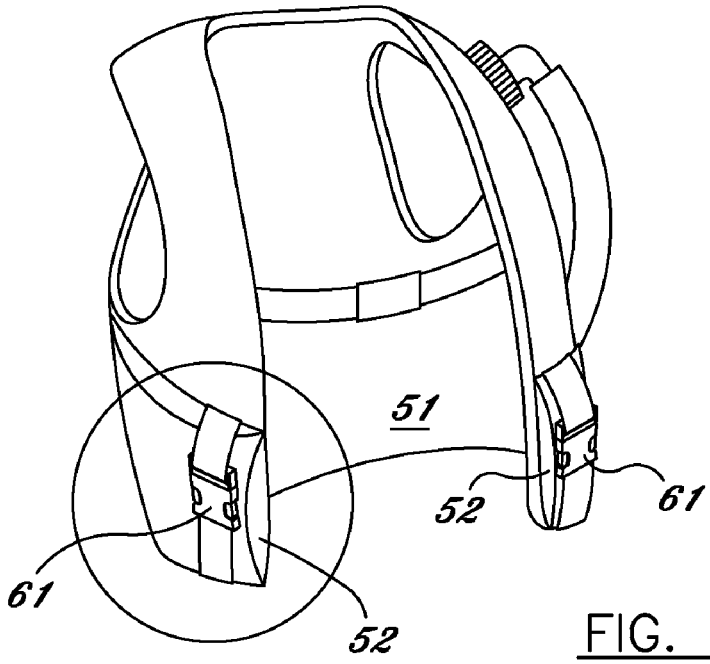
FIG. 29 is a perspective view of a further additional active control releasable ballast system of the present invention shown in use with a buoyancy compensator and also illustrating the associated dive equipment having a pair of active control releasable ballast systems.

As seen in FIG. 32, an elastic bridge 71 can be added to the embodiment of FIG. 29 to further secure ballast 56 when side release buckle 61 is in an open position to a degree in which reasonable effort of pull releases ballast member 56 in a controlled fashion.

As seen in FIG. 33, side release buckle 61 acts as single point active fastening device by securing removable ballast member 56 itself inside fixed pocket 52 by sufficiently closing the pleated expandable "mouth" section of the outer fabric of fixed buoyancy compensator ballast pocket 52 closed.

In all non-handle 66 embodiments, it is preferred that the half of side release buckle 61, which is attached to weight member 56 or weight member pocket 54, be pre-disposed in a ergonomically disposed position that allows a natural and intuitive acquisition by the wearer (diver) and/or his or her dive buddy after disengagement from the other half of side release buckle 61. This same concept applies to the cold-water/technical version embodiments of the present that are provided with a separate handle 66 attached to weight member 56 or pocket 54 with both pieces of side release buckle 61 remaining attached to the dive equipment such as, but not limited to, dive belt 53 or buoyancy compensator 51.

The present invention is also unique in that it provides for active control of releasable ballast 56 in sequential fashion with time/use irrelevance. The use of side release buckle 61, such as, but not limited to a fastex buckle, as the release mechanism is also unique and teaches away from current industry thinking and focus of hook and loop release mechanisms. The use of side release buckle 61 is completely reliable, predictable, and typically cost less than hook and loop release mechanisms. Side release buckle 61 is a positive acting device and provides audible and tactile indication of engagement, which is not provided with current hook and loop mechanisms. Side release buckle 61 is not limited to any one color. Side release buckle 61 preferably requires two distinct ergonomically opposed fingers to cause the action of disengagement of male and female sections 62 and 64 of buckle 61 to occur, negating the concern of accidental release to as close to zero as mechanically feasible yet retaining superior ease of release. The structure of buckle 61 also allows for the release of weight 56 to be a deliberate and conscious act by the releaser (i.e. diver, dive buddy, etc.). The positioning of the active control ballast systems 50 on the dive equipment, allows opposing fingers of either hand of the diver or dive buddy to either active control ballast system 50 attached to the dive equipment, which is typically two systems. However, one or more systems 50 can be attached to the dive equipment and all are considered within the scope of the invention.

Figure 10:
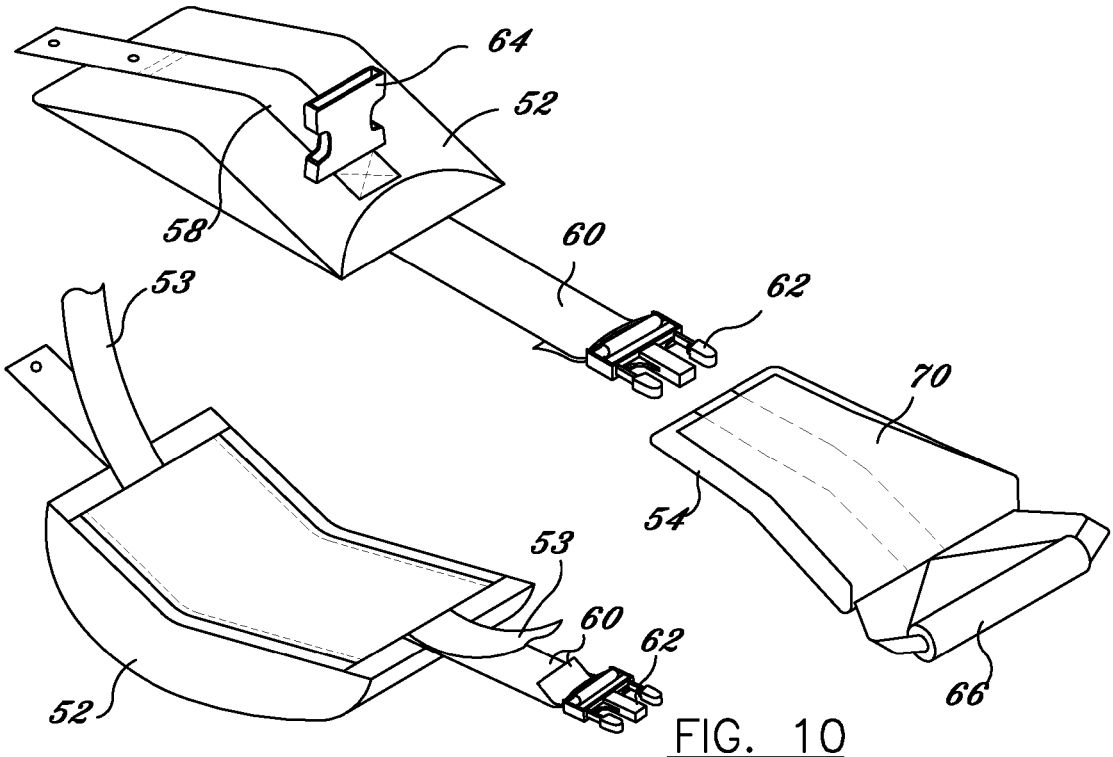
FIG. 10 are various view of the embodiment of Figure shown and a removably attachable version and used with a harness type buoyancy compensator.
Figure 11:
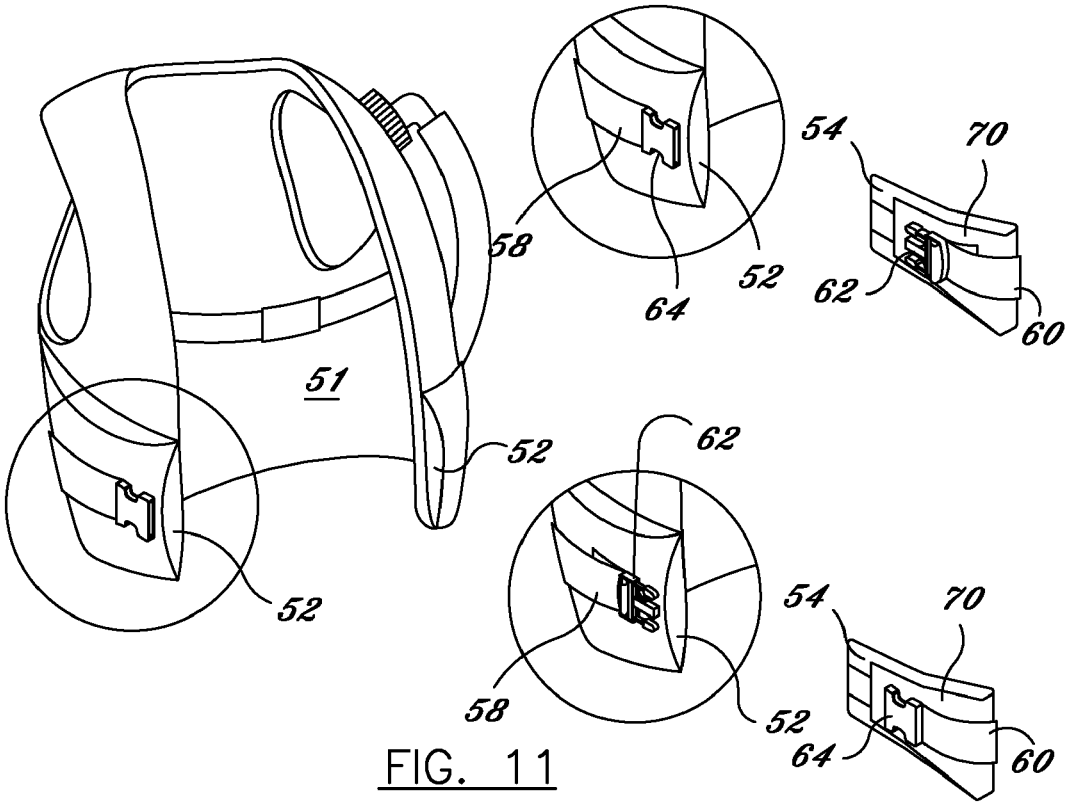
FIG. 11 are various views of the embodiment of FIG. 2.
Figure 19:
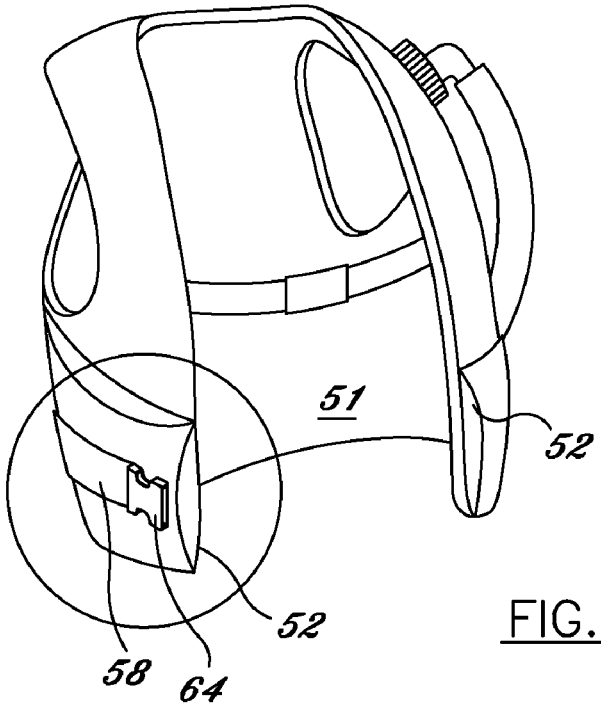
FIG. 19 is a perspective view showing the fixed pocket incorporated into a buoyancy compensator.

As seen in FIG. 10, all of the embodiments and versions of active control ballast system 50 can be provided as a removably attachable fixed pocket 52 system. This removable embodiment can be used or set for Technical Back Plate Harness type BC systems and as an add on to other dive equipment, such as, but not limited to, dive belts. Preferably the removable design can be constructed to universally fit most of the popular Technical diving back plate harness systems in service today. The various embodiments and versions of the present invention can be permanently fabricated into the dive equipment, such as a conventional BC system 51 pocket area (preferably behind/below/inside of, and without interfering with convention BC exterior pocket 55) or on a dive belt 53, when originally manufactured (See FIGS. 11, 15 and 19). Alternatively, all of the versions of system 50 can be provided as a retrofit/upgrade with the use of field usable fastening devices such as snap rivets, grommets, common sewing, loops, etc.

When used with buoyancy compensator 51, side release buckle 61 and straps 58 and 60 can be provided over pocket 52 parallel to the length of pocket 52 and perpendicular over a mouth portion of pocket 52. This position of system 50 allows the invention to act as a singular attachment mechanism and single point active fastening device and handle for the control of ballast component 56 pre-insertion, during use and post release.

All of the various described embodiments and versions described above can be configured ninety (90) degrees downward, thus, pointing the opening of fixed pocket 52 toward the divers feet instead of away from the body. This downward direction corresponds with the direction the diver's eyes look. Furthermore, a variety of the methods of application demonstrated above are immediately applicable to tank, buoyancy compensator, and/or personal flotation device mounted counter weighting and/or tank, buoyancy compensator, and/or personal flotation device mounted trim weight applications.

Figure 34:
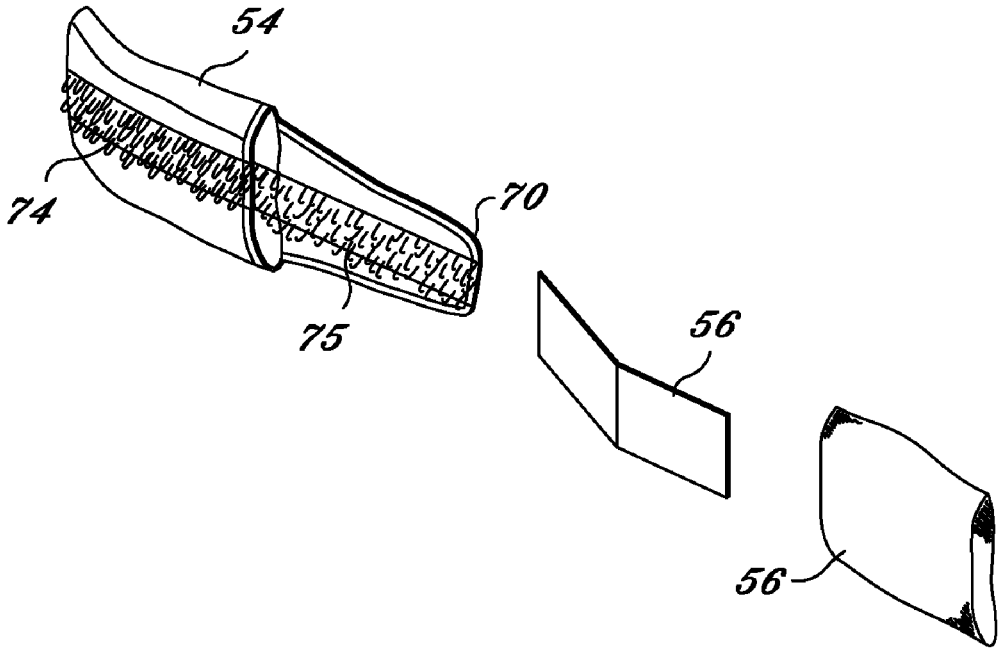
FIG. 34 illustrates an exploded perspective view of a removable pocket member in accordance with the present invention.

As seen in FIG. 34, at least a portion, and preferably a large percentage of the interior surfaces of removable pouch 54_can be covered with hook and loop fastening members 75.

Once weight 56 is inserted within removable pouch 54, pressure is inserted on pouch 54, causing portions of hook and loop fastening members 75 to mate around or to weight 56, thus maintaining weight 56 in place within pocket 54.

In all embodiments, ballast member 56 is not limited to any one particular size, shape or poundage of weight, and all various sizes, shape or weight for ballast member 56 can be used and are considered within the scope of the invention. Furthermore, the type of material used for weight 56 is also not considered limited to any one type of material.

To install active control ballast system 50 (add on or upgradeable versions), preferably the installer removes conventional equipment attached to the waist belt of the harness or a dive belt. The belt harness is then threaded through a sleeve 79 in the back of fixed pouch 52. A grommet nearest the pouch 52 can preferably line up with the holes in a bottom corner of a conventional backplate (not shown), and can be secured with a nut and bolt. The grommets on the end of the webbing preferably line up with bottom tank mounting holes of the backplate. These grommets can be preferably secured with the bottom tank mounting bolts. Once installed, the previously removed conventional equipment is reattached to the waist belt.

System 50 can also be provided with a D-ring on one side and can be provided with a relatively small of webbing, preferably two (2") inches, and a buckle. The webbing and buckle secures a light canister in the DIR position.

All embodiments and versions of active control ballast system 50 provide all of the benefits associated with an integrated weight system, while leaving only one unavoidable hassle-weight. Active control ballast system 50 preferably suspends its weight 56 within the perfect position of the dive belt, BC/Harness system or other dive equipment. As the weight bearing area is preferably distributed closer to the diver's buoyant torso area, the active control ballast system substantially improves the diver trim and control. The active control ballast embodiments and versions of the present invention allow intelligent management of diver's ballast 56, as the diver is in control of buoyancy and trim both in and out of the water.

The use of side release buckle 61 is specifically chosen to resolve the issue of accidental release by a variety of undetectable situations that often occur when diving. Divers frequent closed in areas in reefs, shipwrecks, and cave systems to name a few. While in close confines a single point release mechanism could potentially come loose without warning by simply making contact with another object. Side release buckle 61 solves this problem by requiring simultaneous activation of two bilaterally opposed, but perfectly ambidextrously disposed "locks". Activation of one of two will not release the weight-retaining member, thus the term Active Control Ballast. The entire active control ballast design is based around active securement/release and optimum use insertion/release on either side by either hand by either the diver or buddy. Though side release buckle 61 is preferred, it is also within the scope of the invention, and considered a substantial improvement over previous designs, to provide a single point, but positive locking device such as a mono-lock side release or push button style mechanical fastener. All the same benefits as above apply except the added safety of the dual simultaneous activation. These alternative positive locking designs are also sufficient technology to those divers that carry an absolute minimum amount of releasable ballast. These designs are preferably used, though not limiting, when an amount of releasable ballast is contained in the active control ballast unit that would not cause a catastrophic rate of ascent in the event of an accidental release of ballast The present invention prevents accidental weight release. Rapid and intentional insertion or removal of weight 56 is possible with either hand by the diver and/or the diver's dive buddy.

It should be understood that all of the embodiments for the present invention active control ballast can be used with a dive belt, weight belt, diver harness, life vest, life jacket, buoyancy compensator, etc., and all are considered within the scope of the invention. Furthermore, each of the various embodiments can be incorporated on the other original piece of dive equipment (i.e. belt, buoyancy compensator, etc.) or can be provided as a stand alone accessory or upgrade for later attachment to preexisting dive equipment, all of these uses are also considered within the scope of the invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An active control releasable ballast system for dive equipment, comprising:

a ballast receiving pocket;

a ballast member stored within said receiving pocket prior to release of said ballast member;

a first strap attached at least proximate to said receiving pocket;

a second strap attached at least proximate to said receiving pocket, said second strap associated with said ballast member;

a side releasable buckle, excluding hook and loop fasteners, said side releasable buckle having a first section and a second section, said first section of said side releasable buckle attached to said first strap, said second section of said side releasable buckle attached to said second strap, wherein prior to release of said ballast member said first section and said second section are connected to each other; wherein release of the ballast member from within the receiving pocket is achieved through disconnection of the first section of the side releasable buckle from the second section of the side releasable buckle;

a pouch for holding said ballast member, said pouch stored within said receiving pocket prior to release of said ballast member and said pouch; and a handle attached to said pouch.

2. The active control releasable ballast system of claim 1 wherein said second strap is attached to said pouch.

3. The active control releasable ballast system of claim 1 wherein said pouch having a flap.

4. The active control releasable ballast system of claim 1 wherein a location of said side releasable buckle with respect to said receiving pocket provides for a single point active fastening device and handle for active control of said ballast pre-insertion, during use and post release of said ballast.

5. An active control releasable ballast system for dive equipment, comprising:

a ballast receiving pocket;

a ballast member stored within said receiving pocket prior to release of said ballast member;

a first strap attached at least proximate to said receiving pocket;

a second strap attached at least proximate to said receiving pocket, said second strap associated with said ballast member;

a side releasable buckle, excluding hook and loop fasteners, said side releasable buckle having a first section and a second section, said first section of said side releasable buckle attached to said first strap, said second section of said side releasable buckle attached to said second strap, wherein prior to release of said ballast member said first section and said second section are connected to each other; wherein release of the ballast member from within the receiving pocket is achieved through disconnection of the first section of the side releasable buckle from the second section of the side releasable buckle; and a pouch for holding said ballast member, said pouch stored within said receiving pocket prior to release of said ballast member and said pouch; and a handle attached to said ballast member.

6. The active control releasable ballast system of claim 5 wherein said second strap is attached to said ballast member.

7. An active control releasable ballast system for dive equipment, comprising:

a ballast receiving pocket;

a ballast member stored within said receiving pocket prior to release of said ballast member;

a first strap attached at least proximate to said receiving pocket;

a second strap attached at least proximate to said receiving pocket, said second strap associated with said ballast member;

a side releasable buckle, excluding hook and loop fasteners, said side releasable buckle having a first section and a second section, said first section of said side releasable buckle attached to said first strap, said second section of said side releasable buckle attached to said second strap, wherein prior to release of said ballast member said first section and said second section are connected to each other; wherein release of the ballast member from within the receiving pocket is achieved through disconnection of the first section of the side releasable buckle from the second section of the side releasable buckle; and a slightly curved plate disposed within and attached to said receiving pocket.

8. An active control releasable ballast system for dive equipment, comprising:

a ballast receiving pocket;

a ballast member stored within said receiving pocket prior to release of said ballast member;

a first strap attached at least proximate to said receiving pocket;

a second strap attached at least proximate to said receiving pocket, said second strap associated with said ballast member;

a side releasable buckle, excluding hook and loop fasteners, said side releasable buckle having a first section and a second section, said first section of said side releasable buckle attached to said first strap, said second section of said side releasable buckle attached to said second strap, wherein prior to release of said ballast member said first section and said second section are connected to each other; wherein release of the ballast member from within the receiving pocket is achieved through disconnection of the first section of the side releasable buckle from the second section of the side releasable buckle;

a pouch for holding said ballast member, said pouch stored within said receiving pocket prior to release of said ballast member and said pouch; and a slightly curved plate disposed within and attached to said pouch.

9. An active control releasable ballast system for dive equipment, comprising:

a ballast receiving pocket;

a ballast member stored within said receiving pocket prior to release of said ballast member;

a first strap attached at least proximate to said receiving pocket;

a second strap attached at least proximate to said receiving pocket, said second strap associated with said ballast member;

a side releasable buckle, excluding hook and loop fasteners, said side releasable buckle having a first section and a second section, said first section of said side releasable buckle attached to said first strap, said second section of said side releasable buckle attached to said second strap, wherein prior to release of said ballast member said first section and said second section are connected to each other; wherein release of the ballast member from within the receiving pocket is achieved through disconnection of the first section of the side releasable buckle from the second section of the side releasable buckle;

a pouch for holding said ballast member, said pouch stored within said receiving pocket prior to release of said ballast member and said pouch; and a first slightly curved plate disposed within and attached to said receiving pocket and a second slightly curved plate disposed within and attached to said pouch.

10. A buoyancy compensator, comprising:

a buoyancy compensator shaped body member; and an active control releasable ballast system attached to said body member, said active control releasable ballast system comprising:

a ballast receiving pocket;

a ballast member disposed within said receiving pocket;

a first strap attached at least proximate to said receiving pocket;

a second strap attached at least proximate to said receiving pocket;

a side releasable buckle, excluding hook and loop fasteners, said side releasable buckle having a first male buckle section and a second female buckle section; wherein prior to release of the ballast member said first male buckle section is inserted within said second female buckle section with one or more areas of an inserted portion of the first male buckle section exposed through one or more corresponding openings in said second female buckle section to permit a user to actively control the release of said first male buckle section from said second female buckle section; wherein release of the ballast member from within the receiving pocket of the releasable ballast system is achieved through disconnection of the first male buckle section of the side releasable buckle from the second female buckle section of the side releasable buckle by the user holding and operating the side releasable buckle;

wherein said first male buckle section of said side releasable buckle attached to said first strap, said second female buckle section of said side releasable buckle attached to said second strap, wherein prior to removable of said ballast member from said receiving pocket said first section and said second section are connected to each other;

a pouch for holding said ballast member, said pouch disposed within said receiving pocket prior to release of said ballast member and said pouch; and a handle directly or indirectly attached to said pouch.

11. The buoyancy compensator of claim 10 wherein said second strap is attached to said pouch.

12. A buoyancy compensator, comprising:

a buoyancy compensator shaped body member; and an active control releasable ballast system attached to said body member, said active control releasable ballast system comprising:

a ballast receiving pocket;

a ballast member disposed within said receiving pocket;

a first strap attached at least proximate to said receiving pocket;

a second strap attached at least proximate to said receiving pocket;

a side releasable buckle, excluding hook and loop fasteners, said side releasable buckle having a first male buckle section and a second female buckle section; wherein prior to release of the ballast member said first male buckle section is inserted within said second female buckle section with one or more areas of an inserted portion of the first male buckle section exposed through one or more corresponding openings in said second female buckle section to permit a user to actively control the release of said first male buckle section from said second female buckle section; wherein release of the ballast member from within the receiving pocket of the releasable ballast system is achieved through disconnection of the first male buckle section of the side releasable buckle from the second female buckle section of the side releasable buckle by the user holding and operating the side releasable buckle;

wherein said first male buckle section of said side releasable buckle attached to said first strap, said second female buckle section of said side releasable buckle attached to said second strap, wherein prior to removable of said ballast member from said receiving pocket said first section and said second section are connected to each other;

a pouch for holding said ballast member, said pouch disposed within said receiving pocket prior to release of said ballast member and said pouch; and a handle directly or indirectly attached to said ballast member.

13. The buoyancy compensator of claim 12 wherein said second strap is attached to said ballast member.

* * * * *